US012605640B2

(12) United States Patent
Sornik et al.

(10) Patent No.: US 12,605,640 B2
(45) Date of Patent: Apr. 21, 2026

(54) AMUSEMENT RIDE

(71) Applicant: MACK RIDES IP GMBH & CO. KG, Waldkirch (DE)

(72) Inventors: Frank Sornik, Waldkirch (DE); Thorsten Köbele, Riegel am Kaiserstuhl (DE); Michael Kraus, Ehrenkirchen (DE)

(73) Assignee: MACK RIDES IP GMBH & CO. KG, Waldkirch (DE)

( * ) Notice: Subject to any disclaimer, the term of this patent is extended or adjusted under 35 U.S.C. 154(b) by 817 days.

(21) Appl. No.: 17/918,516

(22) PCT Filed: Dec. 17, 2020

(86) PCT No.: PCT/EP2020/086814
§ 371 (c)(1),
(2) Date: Oct. 12, 2022

(87) PCT Pub. No.: WO2021/209167
PCT Pub. Date: Oct. 21, 2021

(65) Prior Publication Data

US 2023/0145458 A1 May 11, 2023

(30) Foreign Application Priority Data

Apr. 14, 2020 (DE) ..... 102020110219.4

(51) Int. Cl.
*A63G 31/02* (2006.01)
*A63G 31/16* (2006.01)

(52) U.S. Cl.
CPC ..... *A63G 31/02* (2013.01); *A63G 31/16* (2013.01)

(58) Field of Classification Search
CPC ..... A63G 31/02; A63G 31/16
(Continued)

(56) References Cited

U.S. PATENT DOCUMENTS 9,511,299 B1 12/2016 Lai et al.
10,065,123 B2 * 9/2018 Zamperla ..... A63G 7/00
(Continued)

FOREIGN PATENT DOCUMENTS

DE 4132321 A1 4/1993
DE 19600396 A1 7/1997
(Continued)

OTHER PUBLICATIONS

Office Action issued Dec. 30, 2024, in parallel pending Chinese patent application No. 202080099695.7, with English translation.
(Continued)

*Primary Examiner* — Thomas M Sember
(74) *Attorney, Agent, or Firm* — Nath, Goldberg & Meyer; Jerald L. Meyer; Morgan D. Rosenberg

(57) ABSTRACT

The present invention relates to an amusement ride (1), having a frame (10) that can be rotated about a vertical axis (Z), with at least one first seat row arrangement (20) with a linkage (30), at least one row of seats (40), each with at least one seat (41) for a passenger, and a lifting device (50), the at least one row of seats (40) being connected to the linkage (30) via a joint (45), the linkage (30) connecting the joint (45) to the frame (10), and the lifting device (50) being able to lift the row of seats (40) in the orientation of the vertical axis (Z).

19 Claims, 4 Drawing Sheets

Figure 1:
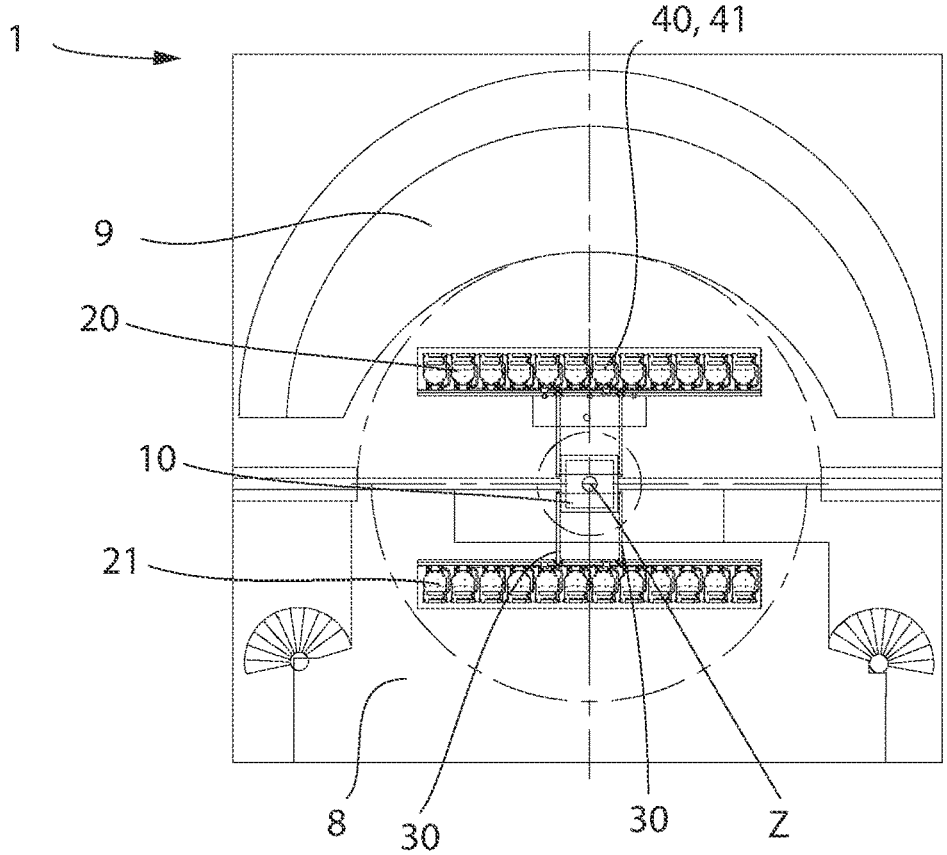

(58) Field of Classification Search
USPC ..... 472/43, 59, 60, 61, 130, 136
See application file for complete search history.

(56) References Cited

U.S. PATENT DOCUMENTS

| | | | | |
|---|---|---|---|---|
| 12,109,505 | B2 | 10/2024 | Cheng | |
| 2005/0048446 | A1 | 3/2005 | Fromyer et al. | |
| 2010/0062866 | A1 * | 3/2010 | Schnuckle ..... | A63G 31/16 472/78 |

FOREIGN PATENT DOCUMENTS

| | | | |
|---|---|---|---|
| EP | 2774663 | A1 | 9/2014 |
| EP | 3213801 | A1 | 9/2017 |
| EP | 3466504 | A2 | 4/2019 |
| JP | H09-066170 | A | 3/1997 |
| JP | H0966170 | A | 3/1997 |
| JP | 2009-254731 | A | 11/2009 |
| WO | 2012/016416 | A1 | 2/2012 |
| WO | 2014/096211 | A1 | 6/2014 |

OTHER PUBLICATIONS

Office Actions issued Feb. 17, 2021, for corresponding German application No. 10 2020 110 219.4.
E2 Simulation system, method and device for dynamic emulation cinema, WO 2012/016416A1 (English translation).
Notice of reasons for rejection issued by the JPO on Dec. 12, 2023, in parallel pending Japanese patent application No. 2022-562768 with English translation.

* cited by examiner

AMUSEMENT RIDE

This is a National Phase Application filed under 35 U.S.C. 371 as a national stage of PCT/EP2020/086814, filed Dec. 17, 2020, an application claiming the benefit of German Application No. 10 2020 110 219.4 filed Apr. 14, 2020, the content of each of which is hereby incorporated by reference in its entirety.

The present invention relates to an amusement ride with the features of claim 1.

Amusement rides are known from the prior art in various embodiments and are stationary or semi-stationary devices that are used in amusement parks or at public festivals to amuse a large number of passengers.

In the past, amusement rides have proven themselves for presenting an experience, in particular a multimedia experience, with all of the passenger's senses being addressed through a combination of movements, images, stereophonic sound, and special effects. In the prior art, amusement rides of this kind are referred to as "Flying Theatre" or "Flying Theater", for example. Flying Theater is also defined as a multimedia, multi-sensory, media-based attraction. The film projection or experience is presented in a film dome.

A generic amusement ride of this kind typically has a row of seats comprising a plurality of seats, the rows of seats being arranged on a frame by means of a hexapod or a Gough-Stewart platform, which has six actuators arranged in a prism. The actuators are mounted in pairs at three positions on a frame and on the row of seats. The hexapod allows the row of seats to be moved in six degrees of freedom, namely in three linear directions of movement and three rotations, namely pitch, roll, and yaw.

In order to ensure a clear view of the film screens of the projection dome, the rows of seats are usually moved forward from a boarding and/or alighting position by the hexapod into the projection dome and remain there during the experience. For the boarding and alighting of passengers, the rows of seats are moved back to a rearward position until a loading area is accessible in front of the rows of seats for boarding and alighting. An amusement ride of this kind is already known, for example, from U.S. Pat. No. 9,311,599 B1.

These generic amusement rides have proven themselves in the prior art, but it has proven to be disadvantageous that operation with a hexapod or a Gough-Stewart platform is complex, costly, and labor-intensive. It has also proven to be disadvantageous that the maximum capacity of the amusement ride is limited and that the safe boarding and alighting of the passengers can only be accomplished with considerable effort in order to prevent the passengers from falling into the film dome.

It has also proven to be disadvantageous in the past that the amusement rides known from the prior art require a considerable amount of space for the design of the Gough-Stewart platform and that the profitability of the rides suffers due to the costly design of the hexapods and the low throughput.

It is the object of the present invention to provide an improved amusement ride that expediently eliminates the disadvantages of the amusement rides known from the prior art. Furthermore, it is the object of the present invention to provide an amusement ride that has a simplified and robust movement device by means of which the at least one row of seats of the amusement ride can be moved in several degrees of freedom, is designed to save space, and allows for highly dynamic movement. The amusement ride according to the invention should also enable a high passenger throughput and safe operation with a low personnel requirement.

These objects are achieved by an amusement ride with the features of claim 1.

Further advantageous embodiments of the present invention are specified in the dependent claims.

The amusement ride according to the invention with the features of claim 1 has a boarding and/or alighting area and an experience area as well as a frame with at least one seat row arrangement, the seat row arrangement comprising a linkage, at least one row of seats with at least one seat for a passenger, and a lifting device. The at least one row of seats is connected to the linkage via a joint, the linkage connecting the joint to the frame, and the lifting device being able to move or lift or lower the at least one row of seats of the at least one seat row arrangement in the orientation of the vertical axis, and it being possible to move the at least one row of seats into the boarding and/or alighting area and the experience area.

The present invention is based on the idea that the at least one row of seats is connected to the frame via a joint and a linkage, with the linkage protruding from the frame in the manner of a cantilever and being held on the frame so as to be pivotable about a single pivot axis. The lifting device can pivot the linkage about the pivot axis, as a result of which the at least one row of seats can be lifted and lowered in a first degree of freedom. The at least one row of seats is moved by further degrees of freedom about the joint between the linkage and the at least one row of seats.

The experience area can comprise a room with a projection surface, wherein the projection surface can be dome-shaped or spherical. The boarding and/or alighting area can have several levels, wherein a number of levels can correspond to a number of rows of seats in a seat row arrangement. In each level, a platform can be provided above which the respective row of seats can be positioned for the passengers to board and alight. For this purpose, the at least one row of seats is correspondingly lifted by the lifting device when the frame is rotated about the vertical axis.

The invention is also based on the idea that, by moving the at least one row of seats of the at least one seat row arrangement, the at least one row of seats can be moved back and forth between the spatially separated boarding and/or alighting area and the experience area. Passengers who are in the boarding and/or alighting area, for example, are preferably unable to perceive the experience in the experience area, and other passengers cannot perceive the boarding and/or alighting process while they are enjoying the experience in the experience area and will therefore not be disturbed or distracted. Both the value of the experience and the throughput of an amusement ride designed in this way can be significantly increased as a result. In a further advantageous embodiment of the present invention, the frame can be rotated about the vertical axis between the boarding and/or alighting area and the experience area. The frame can consequently be rotated about the vertical axis, with the boarding and/or alighting area and the experience area being arranged at different circumferential angles to the vertical axis. The boarding area, the experience area, and the alighting area can be spatially separated, with the boarding area being intended exclusively for passengers to board and the alighting area for alighting from the at least one seat of the at least one row of seats. In such a configuration, the passengers are transported from the boarding area via the experience area to the alighting area, as a result of which the flow of passengers in the amusement ride can be controlled particularly well. Alternatively, the boarding and/or alighting area can be a common area where passengers both board and alight.

In a further advantageous embodiment of the present invention, the at least one row of seats in the boarding and/or alighting area and the experience area can be moved by lifting or lowering in the vertical axis. The boarding and/or alighting area and the experience area can be arranged on different levels in relation to the vertical axis.

Additionally, in a further development of the invention, the at least one row of seats can be moved into the boarding and/or alighting area and the experience area by moving in an axis transverse to the vertical axis.

According to a further advantageous feature of the present invention, the joint makes possible a movement by at least two degrees of freedom, preferably three degrees of freedom. The at least two degrees of freedom preferably include at least two of the three directions of rotation: pitch, roll, and/or yaw, with the joint preferably allowing pitch, roll, and a superimposed roll-pitch movement. In a preferred embodiment, the joint is arranged approximately in a longitudinal axis of the row of seats in a center of mass.

According to a further advantageous embodiment of the present invention, the joint between the row of seats and the linkage is a ball joint, a universal joint, and/or a Cardan joint. The ball joint, the universal joint, and/or the Cardan joint preferably have a pivot point.

Furthermore, according to a development of the invention, at least one actuator is provided by means of which a rolling, pitching, and/or yaw movement of the at least one row of seats can be produced. The at least one actuator can preferably move a single row of seats, or alternatively several rows of seats can be deflected or moved by the at least one actuator using appropriate coupling means. The at least one actuator is supported at one end on the linkage and at the other end on the row of seats and can more preferably be driven electrically, pneumatically, and/or hydraulically. The at least one actuator should have a short reaction time and be highly dynamic in order to be able to produce a dynamic movement of the row of seats that is adapted to the experience.

In a development of the present invention, at least two actuators are provided which together can produce the rolling, pitching, and/or yaw movement. The two actuators can be addressed independently of one another, with mutually coordinated advance behavior producing the rolling, pitching, and/or yaw movement and the rotational movements preferably taking place about a common pivot point, namely the pivot point of the joint.

Furthermore, it has proven to be advantageous if the at least one actuator comprises a crank drive or a rotational drive. The crank drive can comprise a connecting rod which is supported eccentrically on a driven crank and is coupled to the respective row of seats and deflects the row of seats around the joint depending on the position of the driven crank. In a development of the amusement ride, the rotational drive can also be an electric, hydraulic, or pneumatic rotational drive, with hydraulic rotational drives particularly preferably being used.

According to a further embodiment of the present invention, the linkage can be a parallelogram linkage with at least two longitudinal limbs and at least one side limb. The at least two longitudinal limbs are rotatably arranged on the frame each in a pivot axis and are also connected to the at least one side limb. Due to the longitudinal limbs, the at least one side limb is arranged at a distance from the frame. The parallelogram linkage makes it possible to specify the orientation of the side limb in relation to the frame, with the at least one side limb of the parallelogram linkage preferably being arranged in parallel with the vertical axis, that is, vertically. The at least one row of seats can therefore be lifted and lowered at a constant pitch angle without separately actuating the at least one actuator. A support for the joint and the at least one actuator can be provided on the side limb. A screen can also be provided which blocks the passenger's view of the frame, the linkage, the presentation device, or adjacent rows of seats.

In a further embodiment of the present invention, the at least one side limb is coupled to the lifting device. The at least one side limb can connect the longitudinal limbs and, as a component that is purely pressure-loaded, can have a cross-sectional shape that is adapted to the load. By selecting the positioning of the force application point of the lifting device, a type of linkage can be created and the advance movement of the lifting device can be reduced or increased.

In a further advantageous embodiment of the present invention, the lifting device is a telescopic piston, in particular a hydraulic pressure cylinder. Lifting devices of this kind can generate large forces with sufficient dynamics, which is why preferably only a single hydraulic pressure cylinder is used to lift and/or lower the at least one row of seats in the direction of the vertical axis.

In a development of the present invention, the at least one seat row arrangement has at least two rows of seats. The at least two rows of seats are arranged at a distance from one another. It is particularly preferred if the at least two rows of seats of each seat row arrangement are arranged one above the other, that is, are arranged spaced apart from one another in the orientation of the vertical axis. In particular, it is preferable if the at least two rows of seats are each connected to the frame by a parallelogram linkage. The linkages of the at least two rows of seats can be connected to one another by a further side limb or a synchronizing rod which is coupled, preferably directly, to the lifting device. Lifting movements of the lifting device can thus be transmitted in a synchronized manner to the at least two rows of seats and the distance between the at least two rows of seats is rigidly defined. The one lifting device thus lifts and lowers the at least two rows of seats arranged one above the other synchronously, which is why collisions can be ruled out and no further means for synchronizing the lifting position of the at least two rows of seats are required. The power utilization of the lifting device and the cost structure can be improved as a result.

According to a development of the invention, a presentation device, in particular a projector, which is configured to project a film onto a screen, in particular a dome-shaped screen, can be arranged on the frame between two rows of seats that are arranged one above the other.

In a further advantageous embodiment of the present invention, the at least one row of seats has a plurality of seats arranged adjacent to one another. The seats in a row of seats can be arranged either along a straight line or, in a preferred embodiment, along an arched curve and thus have an outwardly directed concave shape in relation to a radial direction of the vertical axis. By arranging the seats in each row of seats in this way, the perspective of the individual passenger on the experience can be improved, but the number of seats in a row can be increased while the amount of space remains the same.

In addition, in a development of the present invention, at least one additional seat row arrangement is provided and the additional seat row arrangement is arranged on the frame at a distance from the first seat row arrangement . . . .

In a preferred embodiment, the first seat row arrangement and the at least one additional seat row arrangement can be arranged about the vertical axis so as to be offset, for example arranged on opposite sides of the vertical axis, namely offset by 180° in a circumferential direction. In order to further increase the capacity of the amusement ride, it is possible to provide more than two seat row arrangements. For example, three, four, or several rows of seats can be distributed evenly around the vertical axis. The lifting device and the at least one actuator of the first seat row arrangement and the at least one additional seat row arrangement can be controlled independently of one another, which is why one of the seat row arrangements can be driven in an experience mode and the other seat row arrangement is in a resting state for the passengers to board and/or alight. With such an arrangement of the two seat row arrangements, the pace, that is, the capacity of the amusement ride can be further increased compared to conventional amusement rides and waiting times can be shortened. The number of rows of seats in the seat row arrangements should be the same and the arrangement of the rows of seats or the linkages on the frame of the seat row arrangements should be linearly symmetrical in the vertical axis.

Alternatively, the at least two seat row arrangements can be arranged on the frame so as to be laterally or vertically offset. For example, the at least two rows of seats can be arranged so as to be offset, with either the seat row arrangement on the frame or the frame with the seat row arrangements moving the respective rows of seats of each seat row arrangement between the boarding and/or alighting area and the experience area by means of a movement in an axis perpendicular to the vertical axis.

If the seat row arrangements are arranged so as to be vertically offset, rows of seats of each seat row arrangement can be arranged alternately or in any order along an axis parallel to the vertical axis. While the rows of seats of one seat row arrangement are arranged in the experience area, the other rows of seats of the other seat row arrangement can be positioned in a boarding and/or alighting area.

According to a preferred embodiment, the amusement ride has at least one boarding and/or alighting area and at least one experience area, it being possible to move the seat row arrangements alternately into the boarding and/or alighting area or the experience area by rotation about the vertical axis, lifting or lowering in the vertical axis, or movement in an axis transverse to the vertical axis. For this purpose, the frame can be driven about the vertical axis by means of a corresponding drive. This rotational movement can be part of the experience or show.

Furthermore, it has proven to be advantageous if an opaque and/or sound-insulating wall is provided between the first seat row arrangement and the second seat row arrangement. The opaque and/or sound-insulating wall is intended to prevent passengers in the boarding and/or alighting area from having the opportunity to prepare themselves for the upcoming experience by observing, as a result of which the surprise effect and the experience value can be increased. The opaque and/or sound-insulating wall also prevents the experience in the experience area of the passengers in the other seat row arrangement from being disturbed by the passengers boarding or alighting.

Figure 2:
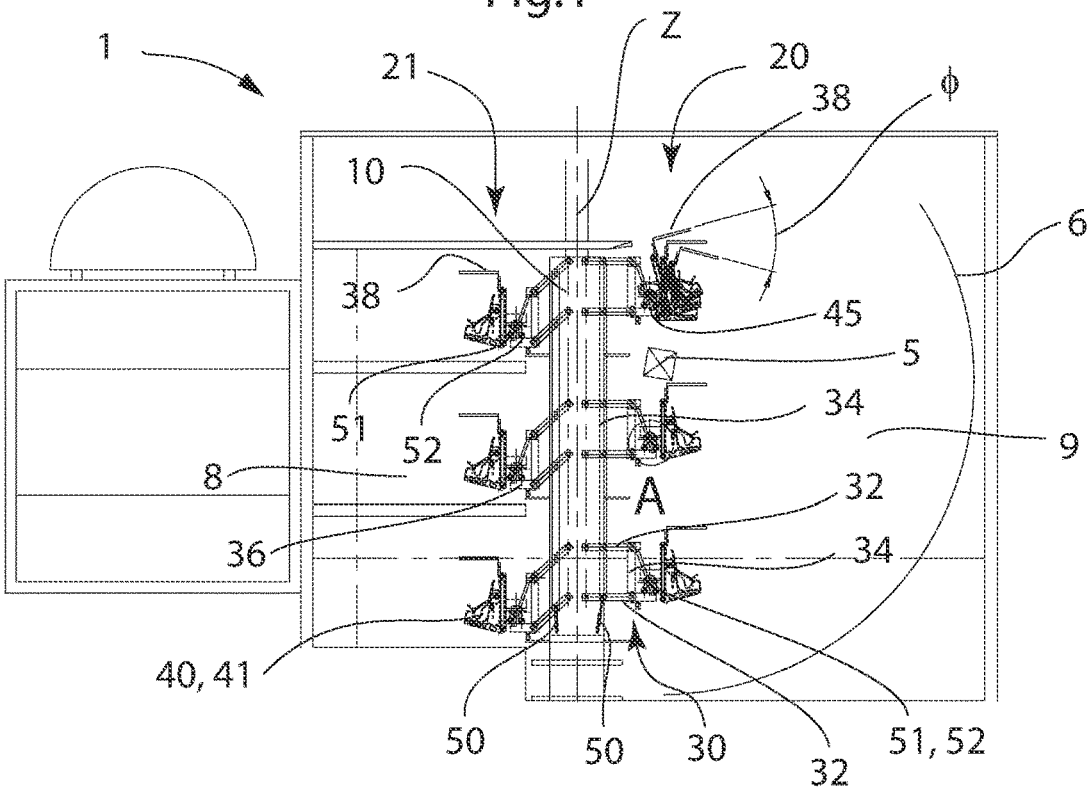
Figure 3:
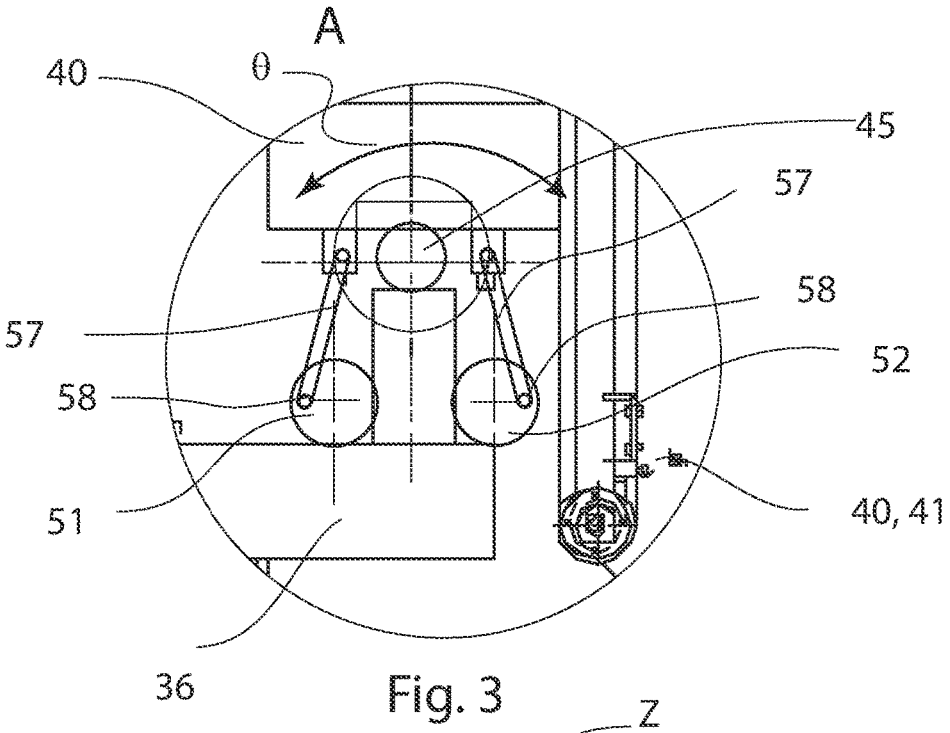
Figure 4:
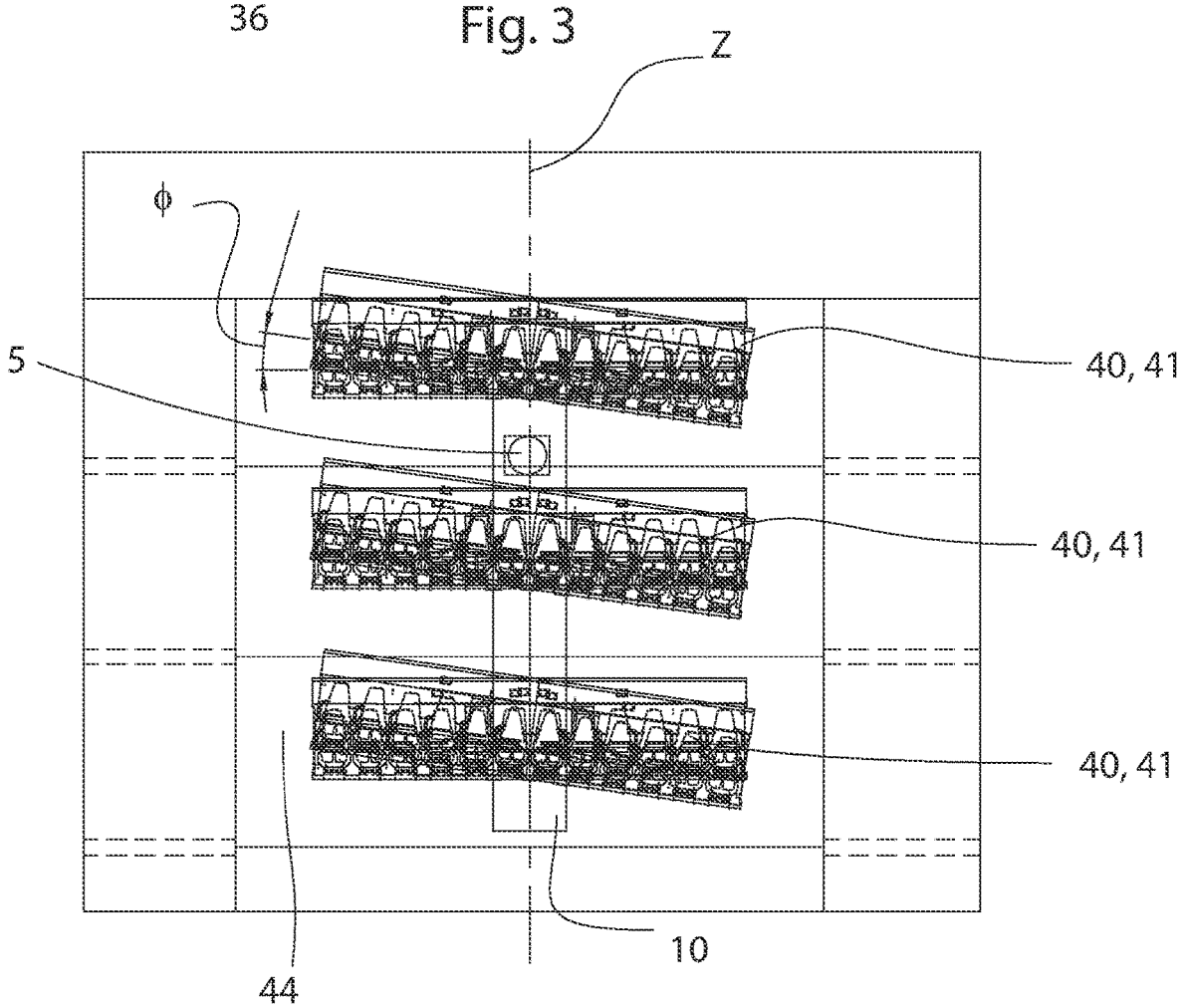
Figure 5:
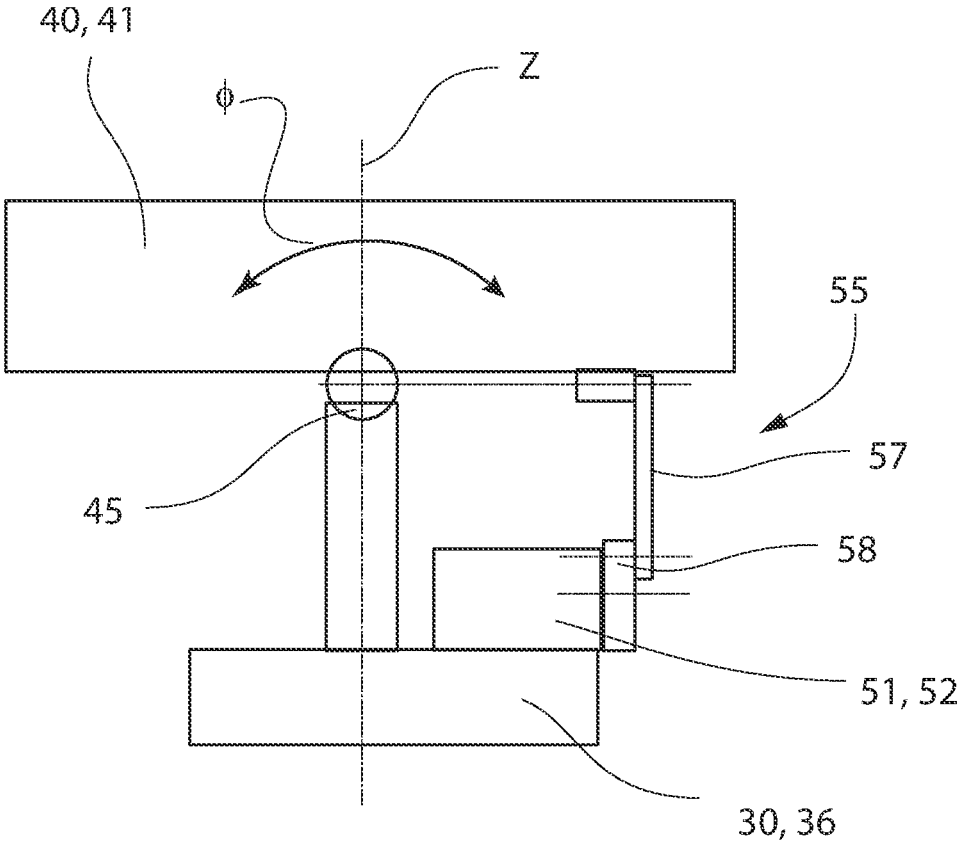
Figure 6A:
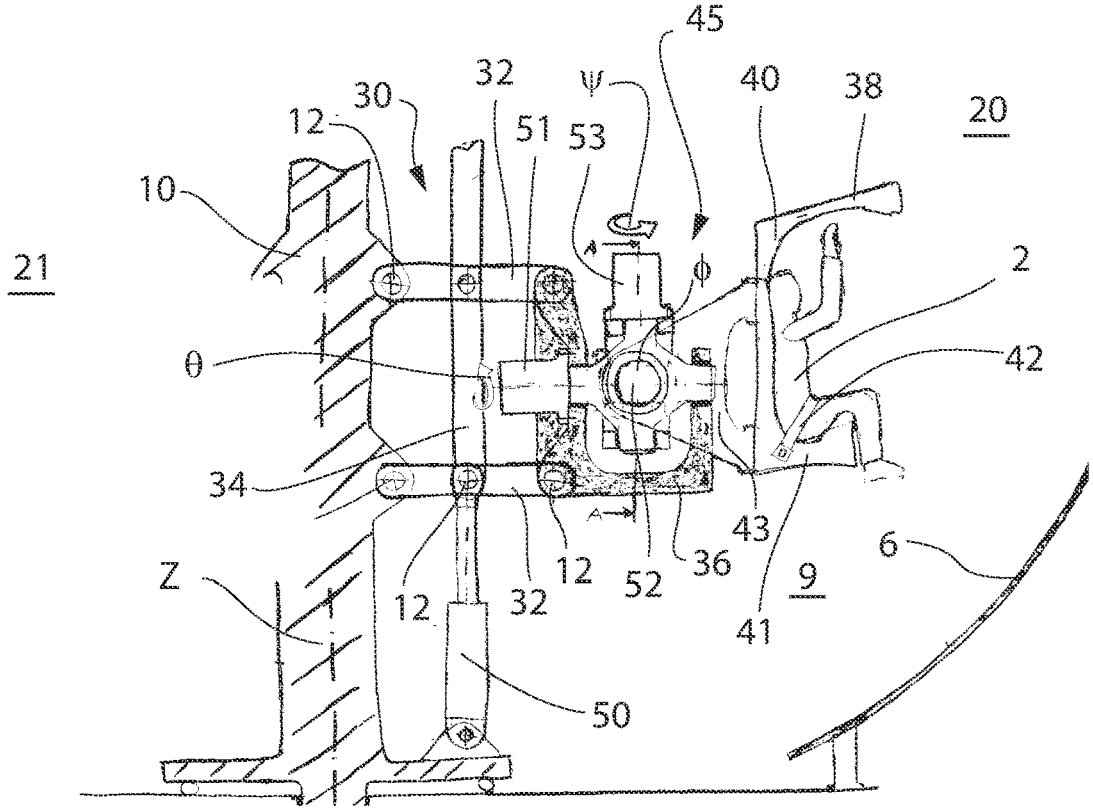
Figure 6B:
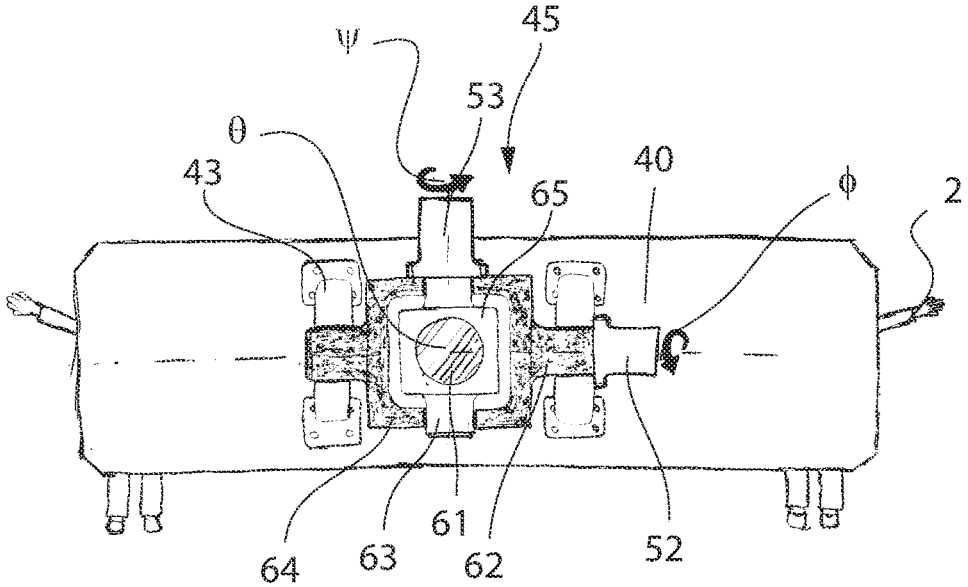

Two exemplary embodiments of an amusement ride according to the invention are described in detail below with reference to the accompanying drawings. In the drawings:

FIG. 1 is a highly simplified schematic view from above of an amusement ride with a frame that can be rotated about a vertical axis and two oppositely arranged seat row arrangements, each with one row of seats that are movably supported on the frame by means of a linkage, and FIG. 2 is a highly simplified and schematic side view of the amusement ride according to FIG. 1, FIG. 3 shows an enlarged representation of detail A according to FIG. 2, FIG. 4 is a highly simplified and schematic plan view of the amusement ride according to FIG. 1, FIG. 5 shows an enlarged representation of detail B according to FIG. 4, FIG. 6*a* shows a second exemplary embodiment of the amusement ride, the joint being designed as a Cardan joint, and FIG. 6*b* shows a sectional representation of the Cardan joint according to section line A-A according to FIG. 6*a*.

In the following, identical or functionally identical components in the one exemplary embodiment are identified by the same reference symbols. For the sake of clarity, not all parts that are the same or functionally the same are provided with a reference number in the individual Figures.

FIG. 1 shows an amusement ride 1, which has a frame 10 which can be rotated about a vertical axis Z and is arranged coaxially with respect to the vertical axis Z. The vertical axis Z or the frame 10 is oriented vertically.

The amusement ride 1 also has two seat row arrangements 20, 21, which are arranged on opposite sides of the vertical axis Z on the frame 10. As can be seen in particular in FIGS. 2 and 4, each seat row arrangement 20, 21 has three rows of seats 40 with a plurality of seats 41 or passenger receptacles, on which passengers 2 (not shown) can take a seat as intended. The seats 41 of the rows of seats 40 are each arranged along a longitudinal axis X of the respective rows of seats 40, each longitudinal axis X, in an initial state, being arranged transversely to a transverse axis Y which protrudes perpendicularly from the vertical axis Z in a radial direction. The orientation of the seats 41 in each row of seats 40 is preferably parallel to the transverse axis Y in the direction facing away from the vertical axis Z. The number of rows of seats 40 in the seat row arrangements 20, 21 is the same.

Each seat 41 can have a retaining device 42 by which the respective passenger can be held in the seat 41 in a form-fitting manner. The retaining device 42 can be, for example, a safety bar or belt as shown in FIG. 6*a*.

Each row of seats 40 is connected to the frame 10 via a linkage 30, with a joint 45 being arranged between the linkage 30 and the row of seats 40, by means of which the row of seats 40 can be rotated at a pitch angle $\phi$ and a roll angle $\theta$. A rotation through a pitch angle $\phi$ of ±15° is shown in FIG. 2 on the left as an example. Each row of seats 40 can also be rotated about the joint 45 by the roll angle $\theta$ independently of the pitch angle, wherein the roll angle $\theta$ can be approximately ±10° according to the illustration in FIG. 4. Accordingly, the joint 45 allows a rotational movement in at least two degrees of freedom. The joint 45 is arranged in the transverse axis Y.

The joint 45—as shown in FIGS. 3 and 5—can be designed as a ball joint, with the ball joint supporting the respective row of seats 40 in the respective longitudinal axis X centrally, that is, in a plane of the center of gravity.

The linkage 30 is designed as a parallelogram linkage, with each row of seats 40 being connected to the frame 10 via a parallelogram linkage. The parallelogram linkage has a plurality of transverse limbs 32 and vertical limbs 34 spanning a trapezium. The transverse limbs 32 are supported at one end on the frame 10 by a rotational joint 12 so as to be rotatable about a pivot axis and protrude from the frame 10 in the manner of a cantilever. At the other end, the transverse limbs 32 are connected on the side facing away from the frame 10 via the vertical limb 34 by means of additional rotational joints 12. On the side of the vertical limb 34 facing away from the frame 10, a support 36 is provided on which the joint 45 supporting the rows of seats 40 is arranged. A screen 38 can also be provided which blocks the passenger's view of the technology of the amusement ride 1.

The rows of seats 40 in each seat row arrangement 20, 21 are arranged so as to be spaced apart from one another in the vertical axis Z, as a result of which there is a sufficient distance between the rows of seats 40 in order to avoid collisions, for example. The rows of seats 40 or the linkages 30 of the rows of seats 40 of the two seat row arrangements 20, 21 are preferably arranged symmetrically about the vertical axis Z.

Furthermore, a first actuator 51 and a second actuator 52 are provided on the support 36. The first actuator 51 and the second actuator 52 can be designed as a crank drive 55 and can each have a crank 58 and a connecting rod 57, each connecting rod 57 being coupled to the row of seats 40. Each connecting rod 57 is supported on the actuator 51, 52 on a crank 58 so that the connecting rod 57 applies a corresponding force or torque to the rows of seats 40 depending on the position of the crank or the direction of rotation of the actuator 51, 52. The torque caused by the force forces a rotational movement about a pivot point of the joint 45 and the corresponding row of seats 40 is deflected. The first actuator 51 and the second actuator 52 are arranged in the respective longitudinal axis X at a distance from the joint 45. In the transverse axis Y, the first actuator 51 and the second actuator 52 are arranged at a distance.

The first actuator 51 and the second actuator 52 are advanced in a mutually coordinated manner during the operation of the amusement ride 1. For example, a synchronous rotational movement in respective opposite directions of the two actuators 51, 52 according to FIG. 3 can produce a rolling movement according to FIG. 4 and a synchronous rotation in the same direction of rotation of the actuators 51, 52 can produce a pitching movement according to FIG. 2.

Furthermore, a lifting device 50 is provided, which according to the exemplary embodiment is a hydraulic cylinder. Each of the seat row arrangements 20, 21 has its own lifting device 50 which is designed to lift or lower all of the rows of seats 40 of the respective seat row arrangement 20, 21. The lifting device 50 can be supported at one end on the frame 10 or on a rotational platform from which the frame 10 can protrude in the vertical axis Z. At the other end, the lifting device 50 can be connected to the linkage 30, as a result of which an advance movement of the lifting device 50 can be converted into a movement of the rows of seats 40 that is approximately parallel to the vertical axis Z. As shown in FIGS. 1 and 3, the lifting device 50 can be connected to the respective linkage 30 or parallelogram linkage of the rows of seats 40 of each seat row arrangement 20, 21 via an additional vertical limb 34, with the additional vertical limb 34 acting as a synchronizing rod by means of which all rows of seats 40 of each seat row arrangement 20, 21 can be lifted and lowered synchronously.

The support 36 is held by the linkage 30 designed as a parallelogram linkage in such a way that the orientation of the support 36 remains unchanged in the spatial directions or Euler angles (roll, pitch, and yaw angles ø, 0, y) when it is lifted or lowered.

When the amusement ride 1 is being operated, the lifting devices 50 of the different rows of seats 20, 21 can be controlled independently of one another and the respective actuators 51, 52 within a row of seats 20, 21 and the two rows of seats 20, 21 can be controlled independently, with the rows of seats 40 of a seat row arrangement 20, 21 preferably moving synchronously with one another.

The amusement ride 1 can also have a boarding and/or alighting area 8 and an experience area 9, with the frame 10 being able to be arranged approximately centrally between the boarding and/or alighting area 8 and the experience area 9.

The boarding and/or alighting area 8 can—as will be explained in detail below—have several levels that can be reached by stairs, by means of which passengers can get into the amusement ride 1 for an experience and, after riding the amusement ride 1, can leave the amusement ride 1 again. In order to ensure a smooth and throughput-optimized process, the passengers are directed to the amusement ride 1 through an entrance that is physically separate from an exit.

The experience area 9 can comprise a room with a projection surface, with the projection surface being designed as a picture dome 6 in the present embodiment, on which image representations can be reproduced. In addition, suitable means can be provided in the experience area 9 in order to reproduce stereophonic sound or special effects, through which a multimedia, multi-sensory, media-based experience can be presented to the passenger.

Referring again to FIG. 1, it can be seen that one of the seat row arrangements 20 is arranged in the boarding and alighting area 8, while the second seat row arrangement 21 is arranged in the experience area 9. Passengers who are on one of the seats 41 of the row of seats 40 of the second seat row arrangement 21 can experience a multimedia, multi-sensory, media-based experience, while other passengers can board or alight in the boarding and/or alighting area 8. As soon as the experience is over, the frame 10 of the ride can be rotated about the vertical axis Z and the two seat row arrangements 20, 21 switch between the experience area 9 and the boarding and/or alighting area 8.

So that the passengers in the experience area 9 can experience the experience undisturbed, the frame 10 between the first seat row arrangement 20 and the second seat row arrangement 21 has a wall 24 which is as soundproof and opaque as possible and, together with a wall of the experience area 9, optically and acoustically decouples said arrangements.

During the experience, the image can be displayed by at least one projector 5, which is arranged on the frame above or below one of the rows of seats. Depending on the image display, both the lifting device 50 of the seat row arrangement 20, 21 arranged in the experience area 9 and the first actuator 51 and/or the second actuator 52 can be actuated.

FIGS. 6*a* and 6*b* show a second exemplary embodiment of the amusement ride 1 which differs from the embodiment already described in the design of the joint 45.

The joint 45 is designed as a Cardan joint, which in the illustrated exemplary embodiment allows a movement through three spatial angles or Euler angles. The Cardan joint enables each row of seats 40 to be adjusted or pivoted into a rolling, pitching, and yaw movement or a superimposed movement in this spatial angle.

The joint 45 has a first joint shaft 61 and a second joint shaft 62 which are connected by an intermediate piece 65. The first joint shaft 61 is arranged parallel to the linkage 30 and is rotatably connected to the linkage 30 or the support 36. Therefore, a rotation of the first joint shaft 61 results in a rolling movement at the roll angle ¢. The second joint shaft 62 is arranged parallel to or at the rear of the row of seats 40 and can be rotatably connected to the row of seats 40 via a connecting means 43. A rotation of the second joint shaft 62 results in a pitching movement at the pitch angle θ.

The second joint shaft 62 surrounds the first joint shaft 61 in a frame section 64, the first joint shaft 61 and the second joint shaft 62 preferably being arranged in such a way that their theoretical central axes (represented by dashed lines) intersect. The frame section 64 can be cuboid in shape and provided with an opening that can be dimensioned such that the second joint shaft 62 can be pivoted by ±30° at the so-called yaw angle ψ, preferably ±15°, in a common plane formed by the two central axes.

The second joint shaft 62 is connected to the first joint shaft 61 via the intermediate piece 65, which has a third joint shaft 63, the third joint shaft 63 being arranged perpendicularly to the second joint shaft 62 and, starting from the frame section 64, being arranged in such a way that the central axes of the first joint shaft 61, the second joint shaft 62, and the third joint shaft 63 intersect at one point. The third joint shaft 63 is rotatably supported on the second joint shaft 62 or the frame section thereof 64 and is connected to the first joint shaft 61 for conjoint rotation.

Each of the joint shafts 61, 62, 63 is assigned an actuator 51, 52, 53, with the first actuator 51 driving the first joint shaft 61, the second actuator 52 driving the second joint shaft 62, and a third actuator 53 driving the third joint shaft 63.

The actuators 51, 52, 53 can be any rotational drives, with the actuators 51, 52, 53 preferably being hydraulic rotational drives. The first actuator 51 is supported on the linkage 30 or the support 36, the second actuator 52 on the row of seats 40, and the third actuator 53 can be arranged on either the first joint shaft 61 or the second joint shaft 62 and configured to rotate the third joint shaft 63 relative to the second joint shaft 62 to generate the yaw movement at the yaw angle ψ.

As a result, an amusement ride 1 according to the invention is provided that can be operated in an optimized manner for a high throughput of passengers and has improved power utilization compared to the known amusement rides 1. With the innovative design of the amusement ride 1 the risk of injury is reduced and safe operation with a simultaneous reduction in the number of operators of the amusement ride 1 can be achieved.

LIST OF REFERENCE SIGNS

1 Amusement ride
2 Passenger
5 Film projector
6 Picture dome
7 Wall
8 Alighting area
9 Experience area
10 Frame
12 Rotational joint
20 First seat row arrangement
21 Second seat row arrangement
24 Wall
30 Linkage
32 Transverse limb
34 Vertical limb
36 Support
40 Row of seats
41 Seat
43 Connecting means
45 Joint
50 Lifting device
51 First actuator
52 Second actuator
53 Third actuator
55 Crank drive
57 Connecting rod
58 Crank
61 First joint shaft
62 Second joint shaft
63 Third joint shaft
64 Frame section
65 Connecting portion
X Longitudinal axis
Y Transverse axis
Z Vertical axis
θ Pitch angle
ϕ Roll angle
ψ Yaw angle

The invention claimed is:

1. An amusement ride (1), comprising:
a boarding and/or alighting area (8) and an experience area (9); and
a frame (10) with at least one first seat row arrangement (20),
wherein the at least one first seat row arrangement (20) comprises a linkage (30) with at least one row of seats (40) with at least one seat (41) for a passenger and a lifting device (50),
wherein the at least one row of seats (40) is connected to the linkage (30) via a joint (45),
wherein the linkage (30) connects the joint (45) and the frame (10),
wherein the lifting device (50) can lift the at least one row of seats (40) of the at least one first seat row arrangement (20) in an orientation of a vertical axis (Z),
wherein the at least one row of seats (40) can be positioned in the boarding and/or alighting area (8) and the experience area (9),
wherein the amusement ride further comprises at least one second seat row arrangement (21), the at least one second seat row arrangement (21) being arranged on the frame (10) at a distance from the first seat row arrangement (20), and
wherein the first seat row arrangement (20) and the at least one second seat row arrangement (21) are arranged on opposite sides of the vertical axis (Z).

2. The amusement ride (1) according to claim 1, characterized in that the frame can be rotated about the vertical axis (Z) between the boarding and/or alighting area (8) and the experience area (9).

3. The amusement ride (1) according to claim 1, characterized in that the at least one row of seats (40) can be moved into the boarding and/or alighting area (8) and the experience area (9) by lifting or lowering in the vertical axis (Z) between the boarding and/or alighting area (8) and the experience area (9).

4. The amusement ride (1) according to claim 1, characterized in that the at least one row of seats (40) can be moved into the boarding and/or alighting area (8) and the experience area (9) by a movement in an axis transverse to the vertical axis (Z) between the boarding and/or alighting area (8) and the experience area (9).

5. The amusement ride (1) according to claim 1, characterized in that the joint (45) has at least two degrees of freedom.

6. The amusement ride (1) according to claim 1, characterized in that the joint (45) is a ball joint, a Cardan joint, or a universal joint.

7. The amusement ride (1) according to claim 1, characterized in that at least one actuator (51, 52, 53) is provided and in that the at least one actuator (51, 52, 53) is designed to cause a rolling movement, a pitching movement, and/or a yaw movement of the at least one row of seats (40) about the joint (45).

8. The amusement ride (1) according to claim 7, characterized in that the at least one actuator (51, 52, 53) comprises a crank drive (55) and/or a rotational drive.

9. The amusement ride (1) according to claim 7, characterized in that two actuators (51, 52, 53) are provided which can jointly produce the rolling movement and/or pitching movement of the at least one row of seats (40).

10. The amusement ride (1) according to claim 1, characterized in that the linkage (30) is a parallelogram linkage with at least two transverse limbs (32) and at least one vertical limb (34).

11. The amusement ride (1) according to claim 10, characterized in that the at least one vertical limb (34) is arranged parallel to the vertical axis (Z).

12. The amusement ride (1) according to claim 10, characterized in that the at least one vertical limb (34) is coupled at one end to the lifting device (50).

13. The amusement ride (1) according to claim 1, characterized in that the lifting device (50) is a telescopic piston, preferably a hydraulic pressure cylinder.

14. The amusement ride (1) according to claim 1, characterized in that the at least one row of seats (40) has a plurality of seats (41) arranged adjacent to one another and/or in that the row of seats (40) has a concave shape.

15. The amusement ride (1) according to claim 1, characterized in that the at least one first seat row arrangement (20) has at least two rows of seats (40) which are spaced apart from one another.

16. The amusement ride (1) according to claim 1, characterized in that an opaque and/or sound-insulating wall (24) is provided between the at least one first seat row arrangement (20) and the at least one second seat row arrangement (21).

17. The amusement ride (1) according to claim 1, characterized in that the at least one first seat row arrangement (20) and the at least one second seat row arrangement (21) are alternately movable between the boarding and/or alighting area (8) or the experience area (9) by rotation about the vertical axis (Z), lifting or lowering in the vertical axis (Z), or a movement in an axis transverse to the vertical axis (Z).

18. An amusement ride (1), comprising:

a boarding and/or alighting area (8) and an experience area (9); and a frame (10) with at least one first seat row arrangement (20), wherein the at least one first seat row arrangement (20) comprises a linkage (30) with at least one row of seats (40) with at least one seat (41) for a passenger and a lifting device (50), wherein the at least one row of seats (40) is connected to the linkage (30) via a joint (45), wherein the linkage (30) connects the joint (45) and the frame (10), wherein the lifting device (50) can lift the at least one row of seats (40) of the at least one first seat row arrangement (20) in an orientation of a vertical axis (Z), wherein the at least one row of seats (40) can be positioned in the boarding and/or alighting area (8) and the experience area (9), wherein the amusement ride further comprises at least one second seat row arrangement (21), the at least one second seat row arrangement (21) being arranged on the frame (10) at a distance from the first seat row arrangement (20), and wherein an opaque and/or sound-insulating wall (24) is provided between the at least one first seat row arrangement (20) and the at least one second seat row arrangement (21).

19. An amusement ride (1), comprising:

a boarding and/or alighting area (8) and an experience area (9); and a frame (10) with at least one first seat row arrangement (20), wherein the at least one first seat row arrangement (20) comprises a linkage (30) with at least one row of seats (40) with at least one seat (41) for a passenger and a lifting device (50), wherein the at least one row of seats (40) is connected to the linkage (30) via a joint (45), wherein the linkage (30) connects the joint (45) and the frame (10), wherein the lifting device (50) can lift the at least one row of seats (40) of the at least one first seat row arrangement (20) in an orientation of a vertical axis (Z), wherein the at least one row of seats (40) can be positioned in the boarding and/or alighting area (8) and the experience area (9), wherein the amusement ride further comprises at least one second seat row arrangement (21), the at least one second seat row arrangement (21) being arranged on the frame (10) at a distance from the first seat row arrangement (20), and wherein the at least one first seat row arrangement (20) and the at least one second seat row arrangement (21) are alternately movable between the boarding and/or alighting area (8) or the experience area (9) by rotation about the vertical axis (Z), lifting or lowering in the vertical axis (Z), or a movement in an axis transverse to the vertical axis (Z).

* * * * *